US006460344B1

(12) United States Patent
Steinthorsson et al.

(10) Patent No.: US 6,460,344 B1
(45) Date of Patent: Oct. 8, 2002

(54) FUEL ATOMIZATION METHOD FOR TURBINE COMBUSTION ENGINES HAVING AERODYNAMIC TURNING VANES

(75) Inventors: Erlendur Steinthorsson, Westlake; Michael A. Benjamin, Shaker Heights; David R. Barnhart, Jefferson, all of OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 09/532,534

(22) Filed: Mar. 22, 2000

Related U.S. Application Data

(60) Provisional application No. 60/133,109, filed on May 7, 1999.

(51) Int. Cl.[7] ..... F23R 3/28
(52) U.S. Cl. ..... 60/776; 60/748
(58) Field of Search ..... 60/39.06, 740, 60/748, 776

(56) References Cited

U.S. PATENT DOCUMENTS

| | | | |
|---|---|---|---|
| 2,526,410 | A | 10/1950 | Price |
| 3,013,732 | A | 12/1961 | Webster et al. |
| 3,024,045 | A | 3/1962 | Cleminshaw et al. |
| 3,029,029 | A | 4/1962 | Webster |
| 3,159,971 | A | 12/1964 | Moebius et al. |
| 3,201,050 | A | 8/1965 | Simmons et al. |
| 3,474,970 | A | 10/1969 | Simmons et al. |

(List continued on next page.)

OTHER PUBLICATIONS

Vicini et al., "Inverse and Direct Airfoil Design Using a Multiobjective Genetic Algorithm," AIAA Journal , vol. 35, No. 9, Sep. 1997.

(List continued on next page.)

*Primary Examiner*—Louis J. Casaregola

(57) ABSTRACT

A fuel nozzle for dispensing an atomized fluid spray into the combustion chamber of a gas turbine engine. The nozzle includes a body assembly with an inner fuel passage and an annular outer atomizing air passage. The inner fuel passage extends axially along a longitudinal axis to a first terminal end defining a first discharge orifice of the nozzle. The outer air passage extends coaxially with the inner fuel passage along the longitudinal axis to a second terminal end disposed concentrically with the first terminal end and defining a second discharge orifice oriented such that the discharge therefrom impinges on the fuel discharge from the first discharge orifice. An array of turning vanes is disposed within the outer air passage in a circular locus about the longitudinal axis. Each of the vanes is configured generally in the shape of an airfoil and has a pressure side and an opposing suction side. The vanes extend axially from a leading edge surface to a tapering trailing edge surface along a corresponding array of chordal axes, each of axes is disposed at a given turning angle to the longitudinal axis. The suction side of each vane is spaced-apart from a juxtaposing pressure side of an adjacent vane to define a corresponding one of a plurality of aligned air flow channels therebetween. Atomizing air is directed through the air flow channels to be issued from the second discharge orifice as a generally helical flow having a substantial uniform velocity profile.

8 Claims, 6 Drawing Sheets

U.S. PATENT DOCUMENTS

| | | | | | |
|---|---|---|---|---|---|
| 3,638,865 | A | | 2/1972 | McEneny et al. | |
| 3,675,853 | A | | 7/1972 | Lapera | |
| 3,685,741 | A | | 8/1972 | O'Sickey | |
| 3,866,413 | A | | 2/1975 | Sturgess | |
| 3,899,884 | A | | 8/1975 | Ekstedt | |
| 3,912,164 | A | | 10/1975 | Lefebvre et al. | |
| 3,979,069 | A | | 9/1976 | Garofalo | |
| 3,980,233 | A | | 9/1976 | Simmons et al. | |
| 4,134,606 | A | | 1/1979 | Menti, Jr. | |
| 4,139,157 | A | | 2/1979 | Simmons | |
| 4,168,803 | A | | 9/1979 | Simmons et al. | |
| 4,246,757 | A | | 1/1981 | Heberling | |
| 4,258,544 | A | | 3/1981 | Gebhart et al. | |
| 4,365,753 | A | | 12/1982 | Harding et al. | |
| 4,425,755 | A | | 1/1984 | Hughes | |
| 4,600,151 | A | | 7/1986 | Bradley | |
| 4,613,079 | A | | 9/1986 | Mains | |
| 4,701,124 | A | | 10/1987 | Maghon et al. | |
| 4,735,044 | A | | 4/1988 | Richey et al. | |
| 4,845,940 | A | * | 7/1989 | Beer | 60/748 |
| 4,854,127 | A | | 8/1989 | Vinson et al. | |
| 4,941,617 | A | | 7/1990 | Russell | |
| 4,977,740 | A | | 12/1990 | Madden et al. | |
| 5,062,792 | A | | 11/1991 | Maghon | |
| 5,078,324 | A | | 1/1992 | DuBell et al. | |
| 5,174,504 | A | | 12/1992 | Halvorsen | |
| 5,228,283 | A | | 7/1993 | Sciocchetti | |
| 5,251,447 | A | | 10/1993 | Joshi et al. | |
| 5,299,909 | A | | 4/1994 | Wulf | |
| 5,351,477 | A | | 10/1994 | Joshi et al. | |
| 5,394,688 | A | | 3/1995 | Amos | |
| 5,423,178 | A | | 6/1995 | Mains | |
| 5,435,884 | A | | 7/1995 | Simmons et al. | |
| 5,484,107 | A | | 1/1996 | Holmes | |
| 5,511,375 | A | | 4/1996 | Joshi et al. | |
| 5,570,580 | A | | 11/1996 | Mains | |
| 5,588,824 | A | | 12/1996 | McMillan | |
| 5,605,287 | A | | 2/1997 | Mains | |
| 5,615,555 | A | | 4/1997 | Mina | |
| 5,622,054 | A | | 4/1997 | Tingle | |
| 5,673,552 | A | | 10/1997 | Idleman et al. | |
| 5,697,553 | A | | 12/1997 | Stotts | |
| 5,737,921 | A | * | 4/1998 | Jones et al. | 60/748 |
| 5,740,967 | A | | 4/1998 | Simmons et al. | |
| 5,761,907 | A | | 6/1998 | Pelletier et al. | |
| 5,782,626 | A | | 7/1998 | Joos et al. | |

OTHER PUBLICATIONS

Trosset et al., "Numerical Optimization Using Computer Experiments," ICASE Report No. 97–38, Aug. 1997.

Ta'asan, "Introduction to Shape Design and Control," Carnegie Mellon University; and Sanz, "On the impact of Inverse Design Methods to Enlarge the Aero Design Envelope for Advanced Turbo–Engines," NASA Lewis Research Center.

Sanz, "Lewis Inverse Design Code (LINDES)," NASA Technical Paper 2676, Mar. 1987.

Sanz, "On the Impact of Inverse Design Methods to Enlarge the Aero Design Envelope for Advanced Turbo–Engines," NASA Lewis Research Center.

Sanz et al., "The Engine Design Engine: A Clustered Computer Platform for the Aerodynamic Inverse Design and Analysis of a Full Engine," NASA Technical Memorandum 105838, 1992.

Reuther et al., "Constrained Multipoint Aerodynamic Shape Optimization Using an Adjoint Formulation and Parallel Computers," American Institute of Aeronautics and Astronautics, 1997.

Prandtl and Tietjens in "Applied Hydro– and Aerodynamics," Dover Publ., Inc. (1957).

Oyama et al., "Transonic Wing Optimization Using Genetic Algorithim," AIAA 97–1854, 13$^{th}$ Computational Fluid Dynamics Conference, American Institute of Aeronautics and Astronautics, Jun. 1997, Snowmass Village, CO.

Jameson et al., "Optimum Aerodynamic Design Using the Navier–Stokes Equations," AIAA 97–0101, 35$^{th}$ Aerospace Sciences Meeting & Exhibit, American Institute of Aeronautics and Astronautics, Jan. 1997, Reno, NV.

Goldstein in "Modern Developments in Fluid Dynamics," vol. II, Dover Publ., Inc. (1965).

Elliot et al., "Aerodynamic Optimization on Unstructured Meshes with Viscous Effects," AIAA 97–1849, 13$^{th}$ AIA CFD Conference, American Institute of Aeronautics and Astronautics, Jun. 1997, Snowmass Village, CO.

Dang et al., "Development of an Advanced 3–Dimensional & Viscous Aerodynamic Design Method for Turbomachine Components in Utility & Industrial Gas Turbine Applications," South Carolina Energy Research & Development Center (1997).

GTFS BR Nozzle.

NASA Technical Memorandum 101968 dated Mar., 1989 authored by Dr. Jose Sanz of NASA entitled "A Compendium of Controlled Diffusion Blades Generated by an Automated Inverse Design Procedure".

Reprint from Oct. 1988, vol. 110, Journal of Turbomachinery, authored by Dr. Jose Sanz of NASA entitled "Automated Design of Controlled–Diffusion Blades".

* cited by examiner

FUEL ATOMIZATION METHOD FOR TURBINE COMBUSTION ENGINES HAVING AERODYNAMIC TURNING VANES

RELATED CASES

The present application claims priority to U.S. Provisional Application Ser. No. 60/133,109; filed May 7, 1999.

BACKGROUND OF THE INVENTION

The present invention relates generally to liquid-atomizing spray nozzles, and more particularly to an air-assisted or "airblast" fuel nozzle for turbine combustion engines, the nozzle having a multiplicity of aerodynamic turning vanes arranged to define an outer air "swirler" providing for a more uniform atomization of the fuel flow stream.

Liquid atomizing nozzles are employed, for example, in gas turbine combustion engines and the like for injecting a metered amount of fuel from a manifold into a combustion chamber of the engine as an atomized spray of droplets for mixing with combustion air. The fuel is supplied at a relatively high pressure from the manifold into, typically, an internal swirl chamber of the nozzle which imparts a generally helical component vector to the fuel flow. The fuel flow exits the swirl chamber and is issued through a discharge orifice of the nozzle as a swirling, thin, annular sheet of fuel surrounding a central core of air. As the swirling sheet advances away from the discharge orifice, it is separated into a generally-conical spray of droplets, although in some nozzles the fuel sheet is separated without swirling.

In basic construction, fuel nozzle assemblies of the type herein involved are constructed as having an inlet fitting which is configured for attachment to the manifold of the engine, and a nozzle or tip which is disposed within the combustion chamber of the engine as having one or more discharge orifices for atomizing the fuel. A generally tubular stem or strut is provided to extend in fluid communication between the nozzle and the fitting for supporting the nozzle relative to the manifold. The stem may include one or more internal fuel conduits for supplying fuel to one or more spray orifices defined within the nozzle. A flange may be formed integrally with the stem as including a plurality of apertures for the mounting of the nozzle to the wall of the combustion chamber. Appropriate check valves and flow dividers may be incorporated within the nozzle or stem for regulating the flow of fuel through the nozzle. A heat shield assembly such as a metal sleeve, shroud, or the like additionally is included to surround the portion of the stem which is disposed within the engine casing. The shield provides a thermal barrier which insulates the fuel from carbonization or "choking," the products of which are known to accumulate within the orifices and fuels passages of the nozzle and stem resulting in the restriction of the flow of fuel therethrough.

Fuel nozzles are designed to provide optimum fuel atomization and flow characteristics under the various operating conditions of the engine. Conventional nozzle types include simplex or single orifice, duplex or dual orifice, and variable port designs of varying complexity and performance. Representative nozzles of these types are disclosed, for example, in U.S. Pat. Nos. 3,013,732; 3,024,045; 3,029,029; 3,159,971; 3,201,050; 3,638,865; 3,675,853; 3,685,741; 3,899,884; 4,134,606; 4,258,544; 4,425,755; 4,600,151; 4,613,079; 4,701,124; 4,735,044; 4,854,127; 4,977,740; 5,062,792; 5,174,504; 5,269,468; 5,228,283; 5,423,178; 5,435,884; 5,484,107; 5,570,580; 5,615,555; 5,622,054; 5,673,552; and 5,740,967.

As issued from the nozzle orifice, the swirling fluid sheet atomizes naturally due to high velocity interaction with the ambient combustion air and to inherent instabilities in the fluid dynamics of the vortex flow. However, the above-described simplex or duplex nozzles also may be used in conjunction with a stream of high velocity and/or high pressure air, which may be swirling, applied to one or both sides of the fluid sheet. In certain applications, the air stream may improve the atomization of the fuel for improved performance. Depending upon whether the air is supplied from a source external or internal to the engine, these "air-atomizing" nozzles which employ an atomization air stream are termed "air-assisted" or "airblast." Airblast and air-assisted nozzles have been described as having an advantage over what arc termed "pressure" atomizers in that the distribution of the fluid droplets through the combustion zone is dictated by a airflow pattern which remains fairly constant over most operations conditions of the engine. Nozzles of the airblast or air-assisted type are described further in U.S. Pat. Nos. 3,474,970; 3,866,413; 3,912,164; 3,979,069; 3,980,233; 4,139,157; 4,168,803; 4,365,753; 4,941,617; 5,078,324; 5,605,287; 5,697,443; 5,761,907; and 5,782,626.

Most, if not all, of the aforementioned nozzle designs incorporate swirlers or other turning vanes to impart a generally helical motion to one or more of the fluid flow streams within the nozzle. For example, certain airblast nozzles employ an outer air swirler configured on the surface of a generally-annular member which forms the primary body of the nozzle. In this regard, the body has an inlet orifice and outlet orifice or discharge for the flow of inner air and fuel streams. A series of spaced-apart, parallel turning vanes are provided on a radial outer surface of the body as disposed circumferentially about the discharge orifice. As incorporated into the nozzle, the primary nozzle body is coaxially disposed within a surrounding, secondary nozzle body or shroud such that the radial outer surface of the primary nozzle body defines an annular conduit with a concentric inner surface of the secondary nozzle body for the flow of an outer, atomizing air stream. As each of the vanes is disposed at an angle relative to the central longitudinal axis of the swirler and the direction of air flow, a helical motion is imparted to the atomizing air which exits the nozzle as a swirling stream.

Particularly with respect to airblast or air-assisted nozzles of the type herein involved, the ability to produce a desired fuel spray which is finely atomized into droplets of uniform size is dependent upon the preparation of the atomizing air flow upstream of the atomization point. That is, excessive pressure drop or other loss of velocity in the atomization air can result in larger droplets and a coarser fuel spray. Large or non-uniform droplets also can result from a non-uniform velocity profile or other gradients such as wakes and eddies in the atomizing air flow.

Heretofore, air swirlers of the type herein involved have employed vanes of relatively simple slots or flats, or helical or curved geometries to guide and control fluid flow. In certain applications, however, slots or vanes of these types may provide less than optimum performnance. In this regard, reference may be had to FIG. 1 wherein fluid flow through a pair of parallel, helical vanes is shown in schematic at 10. Each of the helical vanes, referenced at 12*a* and 12*b*, has a leading edge, 14*a–b*, and a trailing edge, 16*a–b*, respectively, and is disposed at a turning or incidence angle, θ, relative to the upstream direction of fluid flow which is indicated by arrow 18. The vanes are spaced-apart radially to define a flow passage, referenced at 20, therebetween.

As may be seen in the schematic of FIG. 1, with the fluid flow being directed to define a lower pressure or suction side, referenced at "S," and a higher pressure or pressure side, referenced at "P," of the vanes 12, some separation of the flow from the suction side is evident beginning at the leading edge 14 of each of the vanes. This separation, which produces the leading edge bubbles depicted by the streamlines referenced at 22*a–b*, and the trailing edge wakes, eddies, vorticities, or other recirculation flow depicted by the streamlines referenced at 24*a–b*, has the effect of reducing the area for fluid flow through the vane passages 20, and of developing strong secondary flows within the stream which can persist many vane lengths downstream of the vanes 12. Thus, and particularly for medium or high turning angles, i.e., between about greater than about 8°, a helical vane profile can result in a diminished flow volume from the nozzle, non-uniform downstream velocity profiles, and otherwise in velocity or pressure losses and than optimum performance.

Turning next to FIG. 2, the fluid flow through a pair of parallel, curved vanes is shown for purposes of comparison at 10'. As before, each of the curved vanes 12*a–b*' has a leading edge 14*a–b*', and a trailing edge 16*a–b*', respectively, and is disposed at a turning or incidence angle, θ, relative to the direction of fluid flow which again is indicated by arrow 18. The vanes are spaced-apart radially to define a flow passage 20' therebetween.

As compared to that of the helical vanes of FIG. 1, the flow through the curved vanes 12' exhibits no appreciable bubble separation at the leading edges 14. However, as the trailing edges 16' of the vanes are not parallel, that is the suction side S of vane 12*a*' is not parallel to the pressure side P of vane 12*b*', losses are produced and the flow becomes non-uniform at that point as shown by the separation referenced at 24 *a–b*'. At large turning angles, i.e., greater than about 15°, the effect becomes more pronounced and may result in pressure losses, non-uniform velocity profiles, and recirculation flows downstream.

In view of the foregoing, it will be appreciated that improvements in the design of fuel nozzles for turbine combustion engines and the like would be well-received by industry. A preferred design would ensure a uniform atomization profile under a range of operating conditions of the engine.

SUMMARY OF THE INVENTION

The present invention is directed principally to airblast or air-assisted fuel nozzles for dispensing an atomized fluid spray into the combustion chamber of a gas turbine engine or the like, and particularly to an outer air swirler arrangement for such nozzles having an aerodynamic vane design which minimizes non-uniformities, such as separation, pressure drop, azimuthal velocity gradients, and secondary flows in the atomizing air flow. The swirler arrangement of the present invention thereby produces a relatively uniform, regular flow downstream of the vanes which minimizes entropy generation and energy losses and maximizes the volume or mass flow rate of air through the vane passages. Without being bound by theory, it is believed that, as the velocity and total pressure of the swirling atomizing air as it impinges the annular liquid sheet is substantially uniform, the formation of large droplets in the atomized sheet is minimized. Moreover, as the velocity of the atomizing air is higher due to reduced total pressure losses, the formation of small droplets is believed to be facilitated. The overall result is that the atomization performance of a given nozzle may be enhanced to provide a smaller mean droplet size over the full range of turning angles typically specified for turbine combustion engines. Equivalently, less atomization air is required to achieve a specified droplet size.

As the name implies, the "aerodynamic" vanes of the present invention are characterized as having the general shape of an airfoil with a leading edging and a trailing edge, and are arranged radially about the outer circumference of the swirler such that the trailing edge surfaces of adjacent vanes are generally parallel. As is shown in U.S. Pat. Nos. 5,588,824; 5,351,477; 5,511,375; 5,394,688; 5,299,909; 5,251,447; 4,246,757; and 2,526,410, aerodynamic vanes have been utilized for turbine blades, and within the nozzle or combustion chamber to direct the flow of combustion air. Heretofore, however, it was not appreciated that such vanes also might be used to guide the flow of atomizing air in airblast nozzles. Indeed, it was not expected that the atomization performance of existing airblast nozzles could be rather dramatically improved while still satisfying such constraints as structural integrity, envelope size, and manufacturability at a reasonable cost.

In an illustrated embodiment, the air-atomizing fuel nozzle of the invention is provided as including a body assembly with an inner fuel passage and an annular outer atomizing air passage. The inner fuel passage extends axially along a longitudinal axis to a first terminal end defining a first discharge orifice of the nozzle. The outer atomizing air passage extends coaxially with the inner fuel passage along the longitudinal axis to a second terminal end disposed concentrically with the first terminal end and defining a second discharge orifice oriented such that the discharge therefrom impinges on the fuel discharge from the first discharge orifice. An array of turning vanes is disposed within the outer atomizing air passage in a circular locus about the longitudinal axis. Each of the vanes is configured generally in the shape of an airfoil and has a pressure side and an opposing suction side. The vanes extend axially from a leading edge surface to a tapering trailing edge surface along a corresponding array of chordal axes, each of which axes is disposed at a given turning angle to the longitudinal axis. The suction side of each vane is spaced-apart from a juxtaposing pressure side of an adjacent vane to define a corresponding one of a plurality of aligned air flow channels therebetween.

In operation, a fuel flow is directed through the inner fuel passage with atomizing air flow being directed through the flow channels of the outer air passage. Fuel is discharged into the combustion chamber of the engine from the first discharge orifice and as a generally annular sheet, with atomizing air being discharged from the second discharge orifice flow as a surrounding swirl which impinges on the fuel sheet. As a result of the uniform velocity profile developed in the swirl by the effect of the aerodynamic turning vanes, the sheet is atomized into a spray of droplets of more uniform size.

The present invention, accordingly, comprises the apparatus and method possessing the construction, combination of elements, and arrangement of parts and steps which are exemplified in the detailed disclosure to follow. Advantages of the present invention include an airblast or air-assisted nozzle construction which provides for a reduction in the mean droplet size in the liquid spray, and which utilizes less atomizing air to effect a specified droplet size. Additional advantages include an airblast or air-assisted nozzle which provides consistent atomization over a full range of turning angles and a wide range of engine operating conditions.

These and other advantages will be readily apparent to those skilled in the art based upon the disclosure contained herein.

BRIEF DESCRIPTION OF THE DRAWINGS

For a fuller understanding of the nature and objects of the invention, reference should be had to the following detailed description taken in connection with the accompanying drawings wherein.

Figure 1:
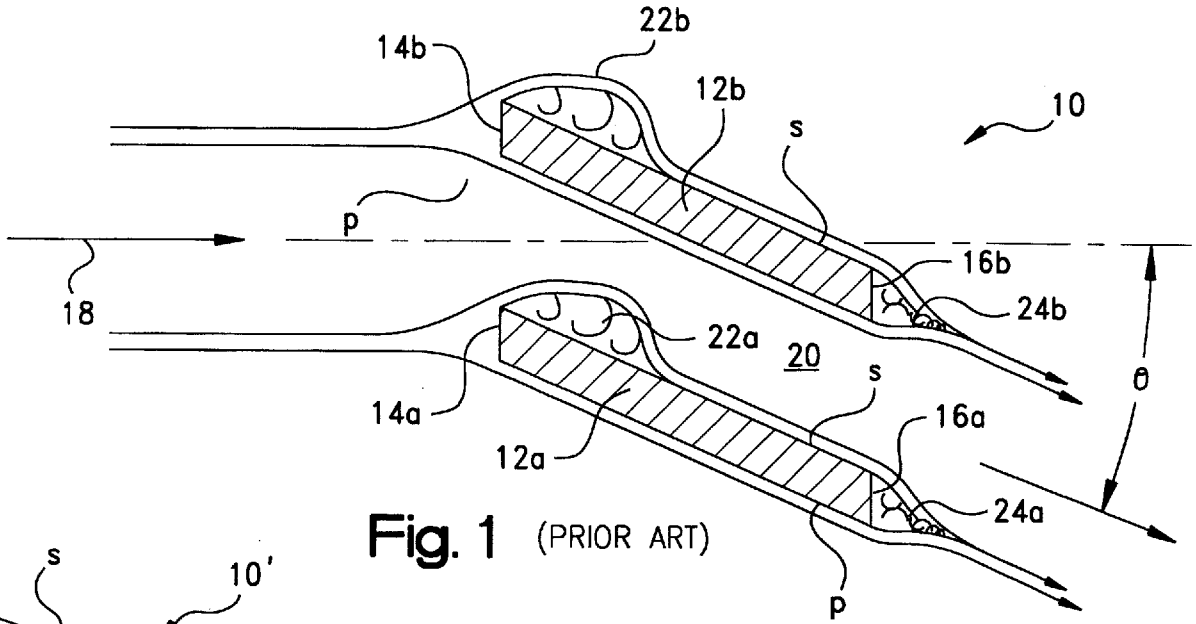
Fig. 1 (PRIOR ART)
FIG. 1 is a schematic diagram showing fluid flow through a pair of helical vanes representative of the prior art.
Figure 2:
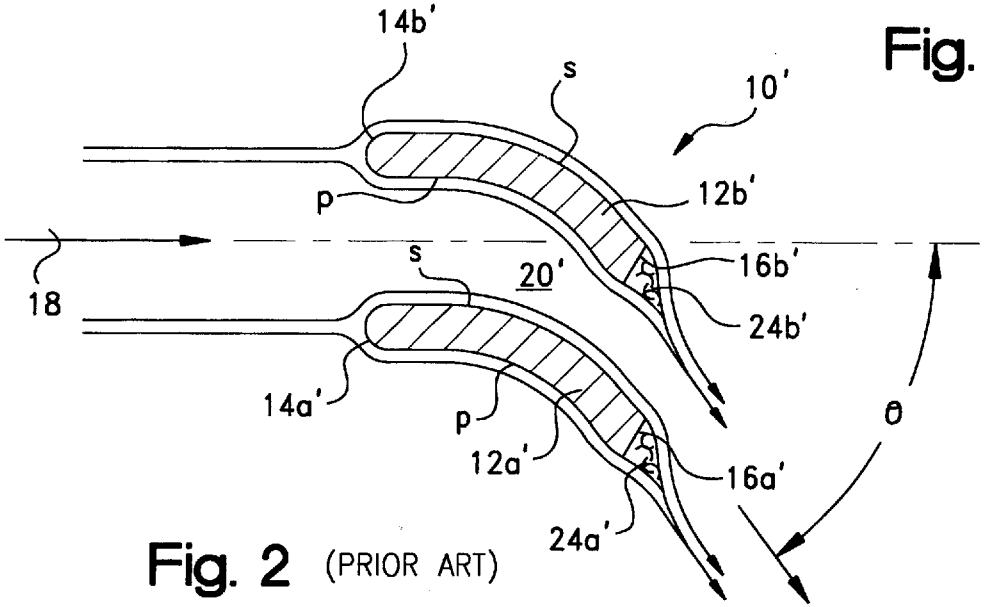
Fig. 2 (PRIOR ART)
FIG. 2 is a schematic diagram as in FIG. 1 showing fluid flow through a pair of curved vanes further representative of the prior art.

These drawings are described further in connection with the following Detailed Description of the Invention.

DETAILED DESCRIPTION OF THE INVENTION

Certain terminology may be employed in the following description for convenience rather than for any limiting purpose. For example, the terms "forward," "rearward" "right," "left," "upper," and "lower" designate directions in the drawings to which reference is made, with the terms "inward," "inner," or "inboard" and "outward," "outer," or "outboard" referring, respectively, to directions toward and away from the center of the referenced element, the terms "radial" and "axial" referring, respectively, to directions or planes perpendicular and parallel to the longitudinal central axis of the referenced element, and the terms "downstream" and "upstream" referring, respectively, to directions in and opposite that of fluid flow. Terminology of similar import other than the words specifically mentioned above likewise is to be considered as being used for purposes of convenience rather than in any limiting sense.

For the purposes of the discourse to follow, the precepts of the nozzle and the aerodynamically-vaned outer swirler thereof are described in connection with the utilization of such swirler within a nozzle of an airblast variety. It will be appreciated, however, that aspects of the present invention may find application in other nozzle, including air-assisted types and the like which utilize an outer flow of atomization air. Use within those such other nozzles therefore should be considered to be expressly within the scope of the present invention.

Figure 3:
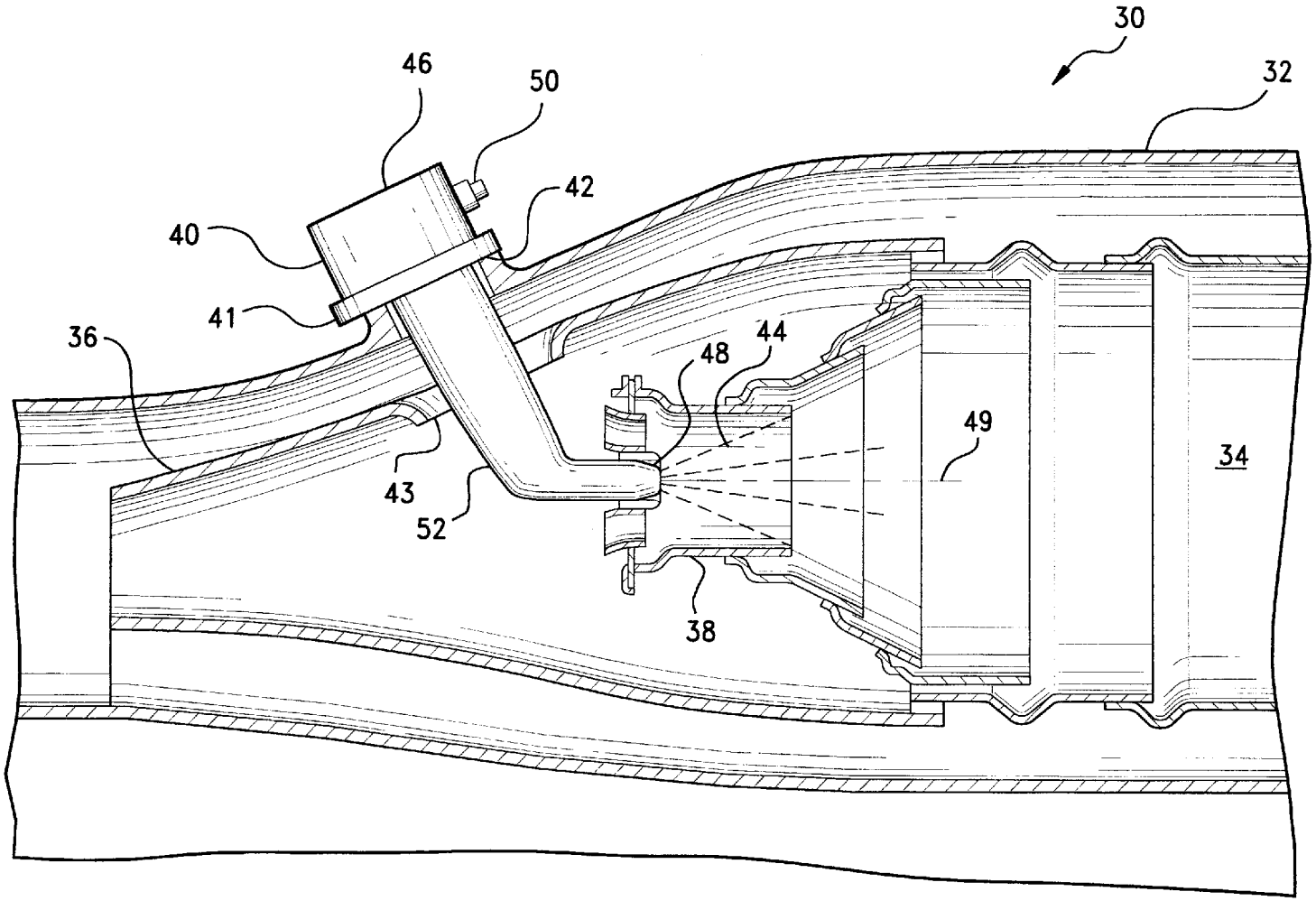
FIG. 3 is a cross-sectional, somewhat schematic view of a combustion assembly for a gas turbine engine.

Referring to the figures wherein corresponding reference characters are used to designate corresponding elements throughout the several views shown, depicted generally at 30 in FIG. 3 is a combustion system of a type adapted for use within a gas turbine engine for an aircraft or the like. System 30 includes a generally annular or cylindrical outer housing, 32, which encloses an internal combustion chamber, 34, having a forward air diffuser, 36, for admitting combustion air. Diffuser 36 extends rearwardly to a liner, 38, within which the combustion is contained. A fuel nozzle or injector, 40, which may have an integrally-formed, radial flange, 41, is received within, respectively, openings 42 and 43 as extending into combustion chamber 34 and liner 38. An igniter (not shown) additionally may be received through housing 32 into combustion chamber 34 for igniting a generally conical atomizing spray of fuel or like, represented at 44, which is dispensed from nozzle 40.

Nozzle 40 extends into chamber 34 from an external inlet end, 46, to an internal discharge end or tip end, 48, which extends along a central longitudinal axis, 49. Inlet end 46 has a fitting, 50, for connection to one or more sources of pressurized fuel and other fluids such as water. A tubular stem or strut, 52, is provided to extend in fluid communication between the inlet and tip ends 46 and 48 of nozzle 10. Stem 52 may be formed as including one or more internal fluid conduits (not shown) for supplying fuel and other fluids to one or more spray orifices defined within tip end 48.

Figure 4:
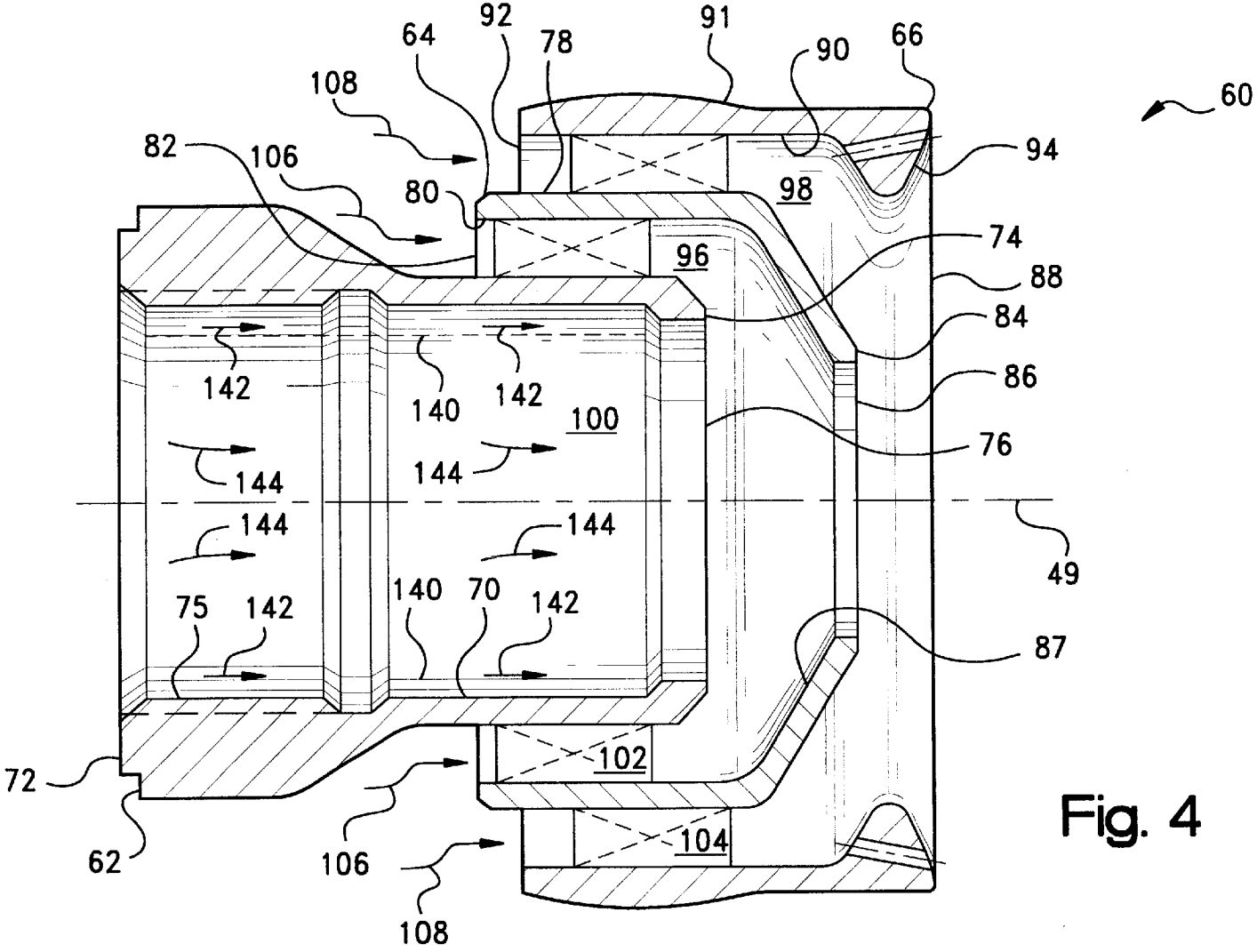
FIG. 4 is a longitudinal cross-sectional view of an airblast or air-assisted nozzle adapted in accordance with the present invention as having a primary body member with aerodynamic outer vanes.

Referring now to FIG. 4., discharge end 48 of nozzle 40 is shown in cross-sectional detail as including a body assembly, 60, involving a coaxial arrangement of a generally annular conduit member, 62, which extends axially along central axis 49, a generally annular first shroud member, 64, which is received coaxially over conduit 62, and, optionally, a generally annular second shroud member, 66, which is received coaxially over first shroud member 64. Each of members 62, 64, and 66 may be separately provided, for example, as generally tubular members which may be assembled and then joined using conventional brazing or welding techniques. Alternatively, members 62, 64, and 66 may be machined, die-cast, molded, or otherwise formed into an integral body assembly 60. The respective diameters of the conduits may be selected depending, for example, on the desired fluid flow rates therethrough.

Conduit member 62 is configured as having a circumferential outer surface, 68, and a circumferential inner surface, 70, and extends along central axis 49 from a rearward or upstream end, 72, to a forward or downstream end, 74. As is shown, upstream end 72 may be internally threaded as at 75, with downstream end 74 which terminating to define a generally circular first discharge orifice, 76.

First shroud member 64, also having an outer surface, 78, and an inner surface, 80, likewise extends along central axis 49 from an upstream end, 82, to a downstream end, 84, which terminates to define a second discharge orifice, 86, disposed generally concentric with first discharge orifice 76. Optionally, the downstream end 84 of first shroud member 64 may be provided to extend forwardly beyond first discharge orifice 76 and radially inwardly thereof in defining an angled surface, 87, which confronts first discharge orifice 76 for the prefilming of the atomizing spray 24 (FIG. 3) dispensed from nozzle 40. Prefilming is described further in commonly-assigned U.S. Pat. No. 4,365,753.

Second discharge orifice 86 thus is defined between the conduit member outer surface 68 and the inner surface 80 of first shroud member 64 as a generally annular opening which, depending upon the presence of prefilming surface 87, may extend either radially circumferentially about or inwardly of primary discharge orifice 46. A third discharge orifice, 88, similarly is defined concentrically with second discharge orifice 86 between an inner surface, 90, of second shroud member 66. Second shroud member 66, which also has an outer surface, 91, likewise extends coaxially with first shroud member 64 along central axis 49 intermediate an upstream end, 92, and a downstream end, 94.

With body assembly 60 being constructed as shown as described, an arrangement of concentric fluid passages is defined internally within nozzle 40 as extending mutually concentrically along axis 49 for the flow of fuel and air fluid components. In this regard, a first or primary atomizing air passage, 96, is annularly defined intermediate the first shroud member inner surface 80 and the outer surface 68 of conduit member 62, with a second or secondary atomizing air passage, 98, being similarly annularly defined intermediate first shroud member outer surface 78 and second shroud member inner surface 90. An inner, i.e., central, fuel passage, 100, is defined by the generally cylindrical inner surface 70 of conduit 62 to extend coaxially through the first and second outer atomizing air passages 96 and 98. Each of passages 96, 98, and 100 extend to a corresponding terminal end which defines the respective first, second, and third discharge orifices 76, 86, and 88. As may be seen, the terminal ends of the first and second outer atomizing air passage 96 and 98 are angled radially inwardly or otherwise oriented such that the discharge therefrom is made to impinge, i.e., intersect, the discharge from inner fuel passage 100.

An array of first turning vanes, one of which is referenced in phantom at 102, is disposed within passage 96, with an array of second turning vanes, one of which is referenced in phantom at 104, being similarly disposed within passage 98. Each of the arrays of vanes 102 and 104 is arranged in a circular locus relative to axis 49, and is configured to impart a helical or similarly vectored swirl pattern to the corresponding first or second atomizing air flow, designed by the streamlines 106 and 108, respectively, being directed through the associated passage 96 or 98.

Figure 5:
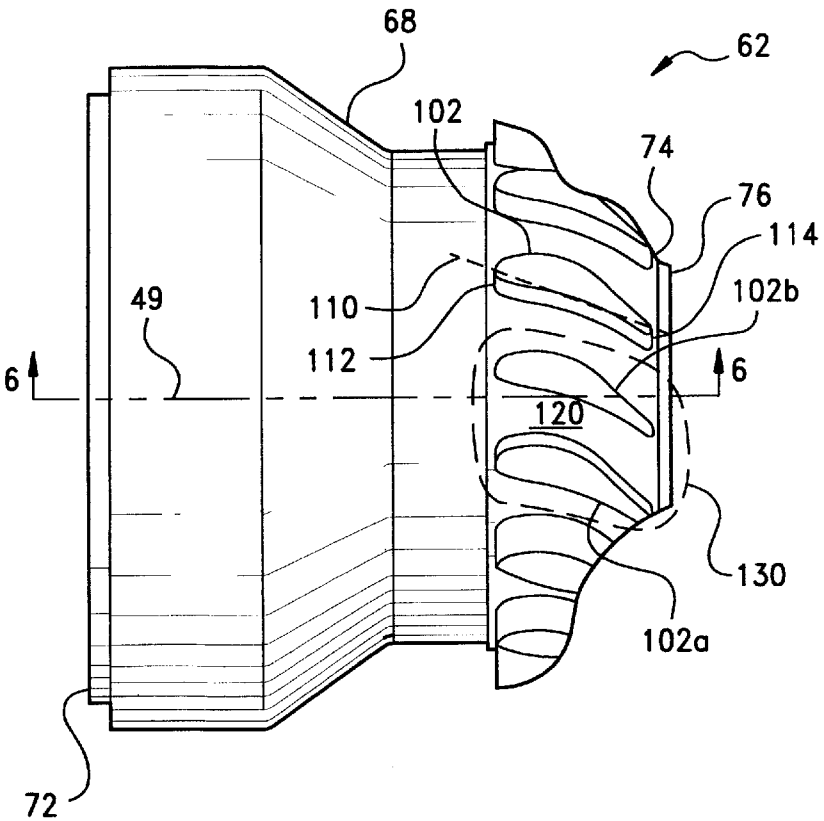
FIG. 5 is a perspective view of the body member of FIG. 4.
Figure 7:
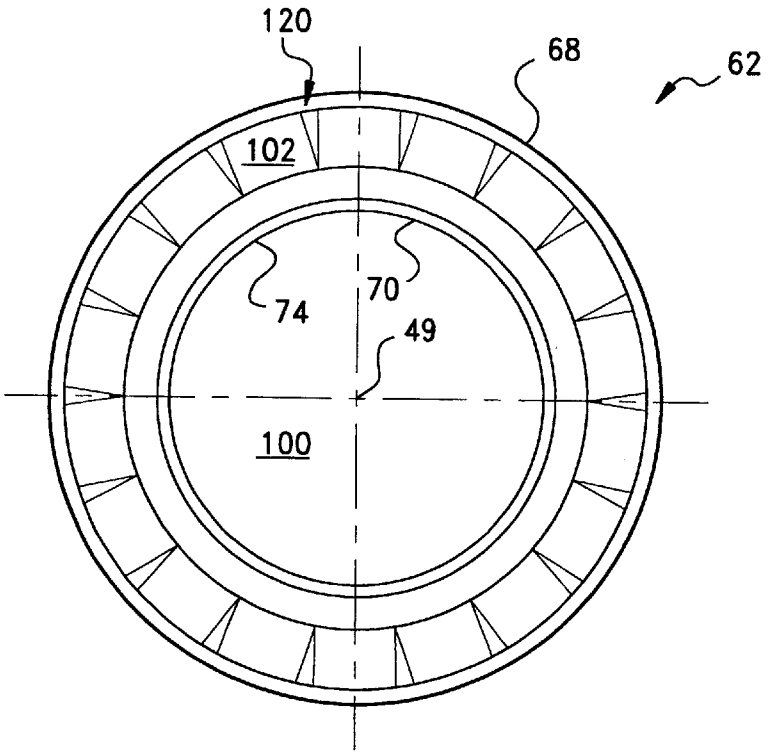
FIG. 7 is a front view of the body member of FIG. 5.
Figure 6:
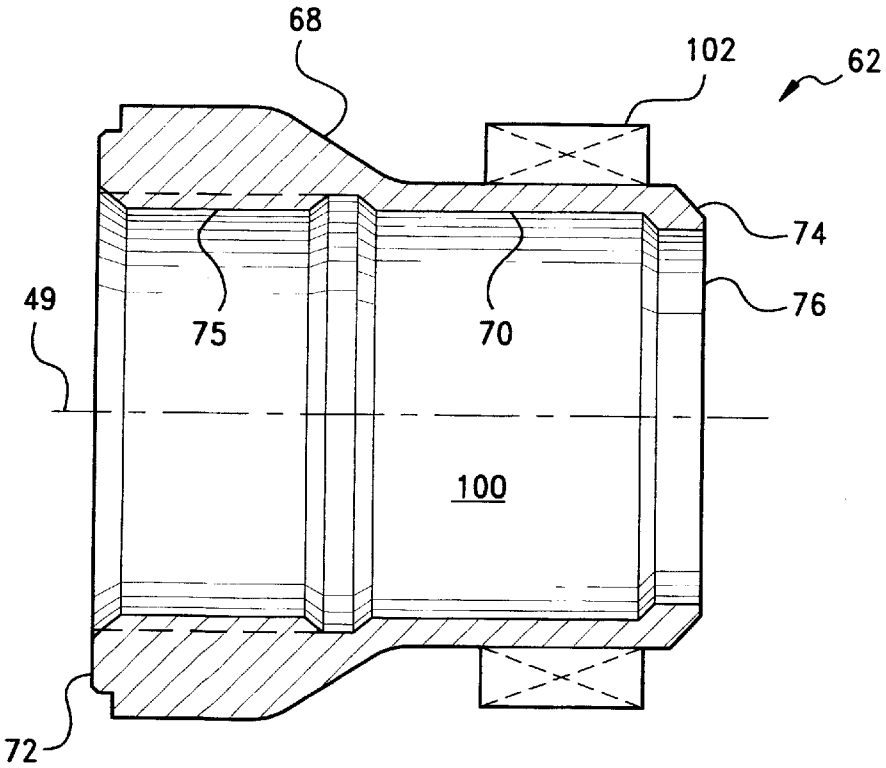
FIG. 6 is a cross-sectional view of the body member of FIG. 5 taken through line 6—6 of FIG. 5.

With additional reference to the several views of conduit member 62 shown in FIGS. 5–7, each of the first turning vanes 102 may be seen to be configured in accordance with the precepts of the present invention to be "aerodynamic." That is, each of vanes 102 is configured as having an outer surface geometry which defines, in axial cross-section, the general shape of an airfoil. Airfoil shapes are well-known of course in the field of fluid dynamics, and are discussed, for example, by Goldstein in "Modern Developments in Fluid Dynamics," Vol. II, Dover Publ., Inc. (1965), and by Prandtl and Tietjens in "Applied Hydro- and Aerodynamics," Dover Publ., Inc. (1957). In general, such shapes are distinguished from elemental mathematical shapes such as circular arcs, elliptical arcs, parabolas, and the like, as extending along a chordal axis, 110, from a generally arcuate leading edge surface, 112, to a tapering trailing edge surface, 114. As may be seen best in the front view of FIG. 7, vanes 102 preferably are equally spaced-apart radially about said longitudinal axis to form a plurality of aligned air flow channels, 120, therebetween.

Figure 8:
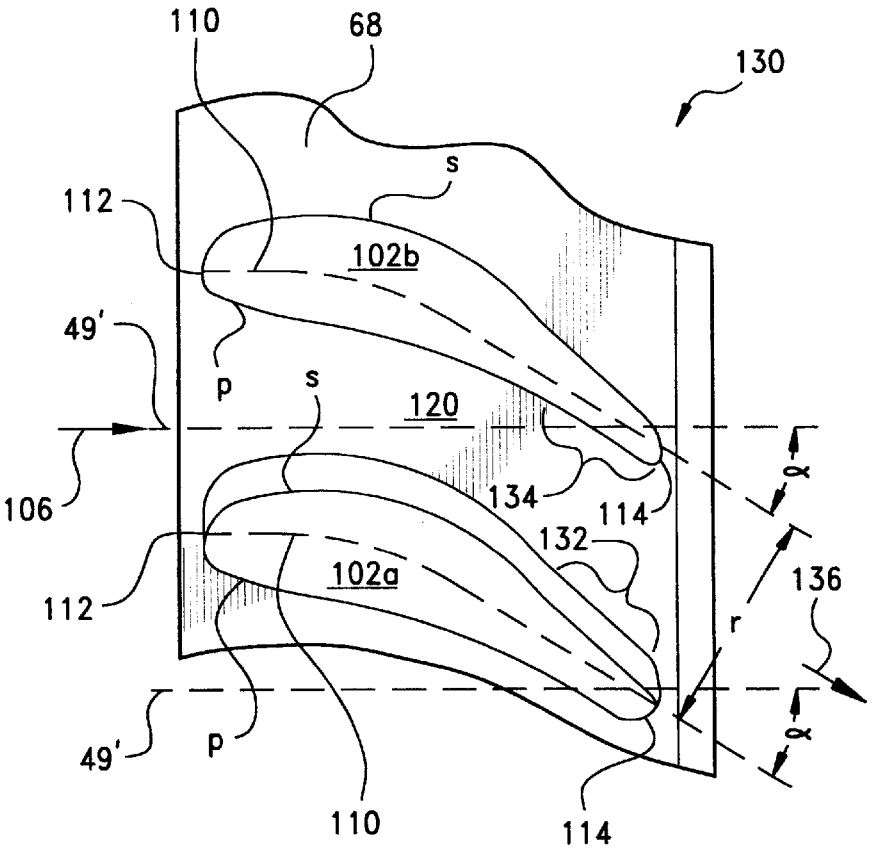
FIG. 8 is a magnified view showing the arrangement of the aerodynamic vanes on the body member of FIG. 5 in enhanced detail.

Referring next particularly to FIG. 8, a pair of adjacent vanes 102, designated 102*a* and 102*b*, is shown in enhanced detail at 130. From FIG. 8, it will be appreciated that, relative to the direction of the atomizing air flow 106, each of vanes 102 further is defined as having a pressure side, P, which may be generally concave, and a suction side, S, which may be generally convex such that, in the illustrated embodiment, vanes 102 are generally asymmetrical. As further is shown, the suction side S of each of the vanes 102 is spaced-apart radially from a juxtaposing pressure side P of an adjacent vane 102 to define an air flow channel 120 therebetween. By "convex" and "concave," it should be understood that the sides S and P each may be configured as simple geometrical curves or, alternatively, as complex curves including one or more inflection points.

For imparting a helical or turning vector to the air flow 106 such that the flow is made to be discharged from orifice 86 (FIG. 4) as a vortex or other "swirling" pattern, vanes 102 are oriented on surface 68 to be presented to the fluid flow at a common incidence or "turning" angle. That is, each of vanes 102 extends axially along a respective one of a corresponding array of mean chordal axes 110, with each axis 110 being disposed at a given trailing edge turning angle, a, relative to longitudinal axis 49 (which is transposed in FIG. 8 at 49'). In most air-atomizing applications of the type herein involved, angle a will be selected to be between about 40–70°.

Further in the illustrative embodiment of FIG. 8, it may be seen that for each vane 102, there is defined a trailing surface segment, referenced at 132 for vane 102*a*, of the suction side S adjacent its trailing edge surface 114 which is disposed generally parallel to a corresponding trailing surface segment, referenced at 134 for vane 102*b*, of the pressure side P of each adjacent vane 102. With such segments 132 and 134 being so disposed in general parallelism, each of the air flow channels 120 may defined as having a substantially uniform angular, i.e., azimuthal, extent or cross-section, referenced at r, along the trailing edge portions of the vanes 102. Such uniform extent r, as measured normal to the fluid flow path, referenced by streamline 136, through the vane channel 120, advantageously assists in producing a generally parallel, uniform flow downstream of the vanes 102. In the manufacture of conduit 62, vanes 102 may be machined, etched, laminated, bonded, or otherwise formed in or on the outer surface 68.

Although not considered critical to the precepts of the invention herein involved, the shape of vanes 102 further may be optimized for the envisioned application using known mathematical modeling techniques wherein the vane surface is "parmetrized." The level of fidelity of the mathematical model can be anywhere from a two-dimensional potential flow, i.e., ideal flow with no losses, up to a full three-dimensional, time-accurate model that includes all viscous effects. For a fuller appreciation of such modeling techniques, reference may be had to: Jameson et al., "Optimum Aerodynamic Design Using the Navier-Stokes Equations," AIAA 97-0101, 35$^{th}$ Aerospace Sciences Meeting & Exhibit, American Institute of Aeronautics and Astronautics, Reno, Nev. (January 1997); Reuther et al., "Constrained Multipoint Aerodynamic Shape Optimization Using an Adjoint Formulation and Parallel Computers," American Institute of Aeronautics and Astronautics (1997); Dang et al., "Development of an Advanced 3-Dimensional & Viscous Aerodynamic Design Method for Turbomachine Components in Utility & Industrial Gas Turbine Applications," South Carolina Energy Research & Development Center (1997); Sanz, "Lewis Inverse Design Code (LINDES)," NASA Technical Paper 2676 (March 1987); Sanz et al., "The Engine Design Engine: A Clustered Computer Platform for the Aerodynamic Inverse Design and Analysis of a Full Engine," NASA Technical Memorandum 105838 (1992): Ta'asan, "Introduction to Shape Design and Control," Carnegie Mellon University; Oyama et al., "Transonic Wing Optimization Using Genetic Algorithim," AIAA 97-1854, 13$^{th}$ Computational Fluid Dynamics Conference, American Institute of Aeronautics and Astronautics, Snowmass Village, Colo. (June 1997); Vicini et al., "Inverse and Direct Airfoil Design Using a Multiobjective Genetic Algorithm," AIAA Journal, Vol. 35, No. 9 (September 1997); Elliot et al., "Aerodynamic Optimization on Unstructured Meshes with Viscous Effects," AIAA 97-1849, 13$^{th}$ AIAA CFD Conference, American Institute of Aeronautics and Astronautics. Snowmass Village, Colo. (June 1997); Trosset et al., "Numerical Optimization Using Computer Experiments," ICASE Report No. 97-38 (August 1997); and Sanz, "On the Impact of Inverse Design Methods to Enlarge the Aero Design Envelope for Advanced Turbo-Engines," NASA Lewis Research Center.

Returning to FIG. 4, second vanes 104 similarly may be defined within passage 98 as being formed in or on the outer surface 78 of first shroud member 64. Indeed, vanes 104 also may be aerodynamically configured in the airfoil shape described in connection with vanes 102. Alternatively, vanes 104 may be conventionally provided as having an elemental shape which may be straight, curved, helical, or the like.

Materials of construction for the components forming nozzle 40 of the present invention are to be considered conventional for the uses involved. Such materials generally will be a heat and corrosion resistant, but particularly will depend upon the fluid or fluids being handled. A metal material such as a mild or stainless steel, or an alloy thereof, is preferred for durability, although other types of materials may be substituted, however, again as selected for compatibility with the fluid being transferred. Packings, O-rings, and other gaskets of conventional design may be interposed where necessary to provide a fluid-tight seal between mating elements. Such gaskets may be formed of any elastomeric material, although a polymeric material such as Vitonθ (copolymer of vinylidene fluoride and hexafluoropropylene, E. I. du Pont de Nemours & Co., Inc., Wilmington, Dle.) is preferred.

In operation, an annular fuel flow, referenced in phantom at 140 in FIG. 4, may be directed as shown by streamlines 142 along the inner surface 70 of passage 100. An inner air flow, shown by streamlines 144, thereby may be being directed through the fuel flow 140 within passage 100, with the primary and secondary atomizing air flows 106 and 108 being directed, respectively, through passages 96 and 98 and vanes 102 and 104. Inner air flow 144 preferably is directed additionally through a conventional inner swirler or plug (not shown) so as to assume a generally helical flow pattern within the fuel annulus 140. The fuel and inner air flows are discharged as a generally annular sheet or cone from the first discharge orifice 76, whereupon the fuel flow is atomized by the impingement of the annular, swirling flows of atomizing air being discharged from orifices 86 and 88. With at least the first vanes 102 being provided as described, the first air flow advantageously is discharged as having a generally uniform velocity profile such that the discharge fuel sheet may be atomized into a spray of droplet of substantially uniform size.

Figure 9A:
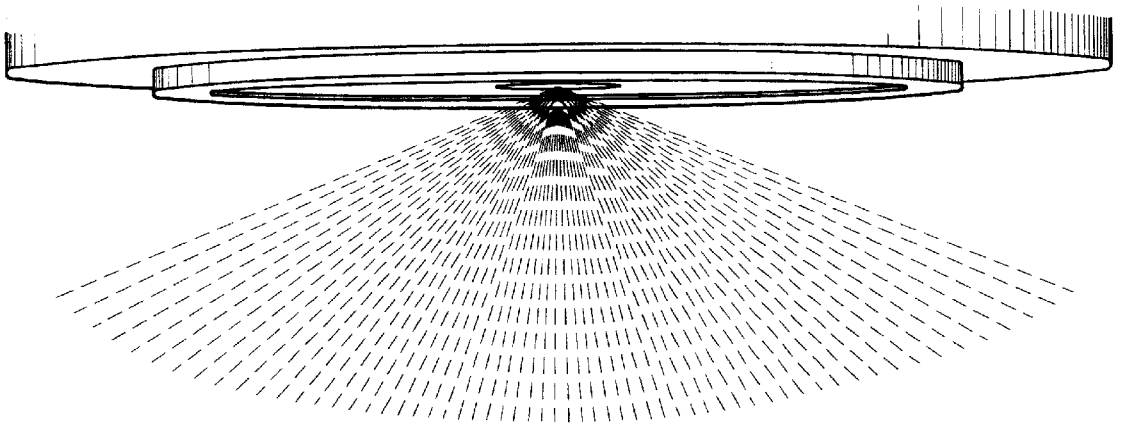
Fig. 9a (PRIOR ART)
FIG. 9A is a photographic representation of an atomized liquid spray from an airblast nozzle representative of the prior art.
Figure 9B:
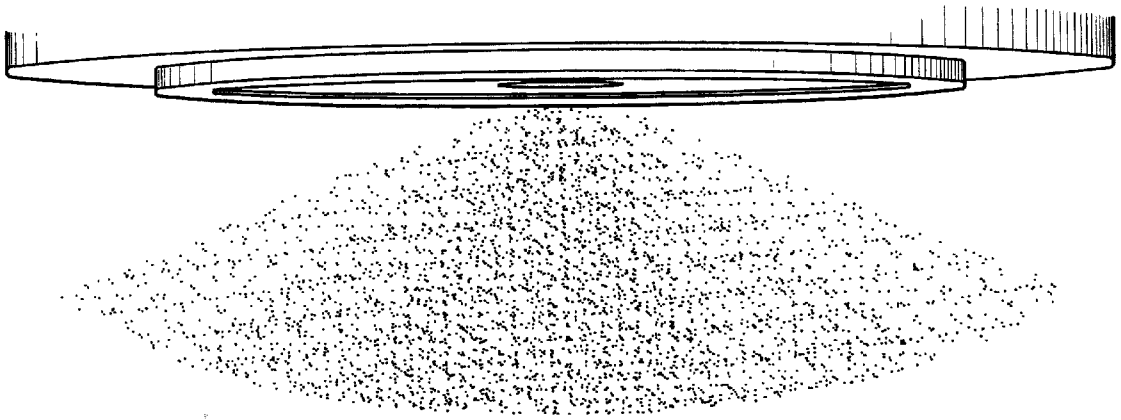
FIG. 9B is a photographic representation of an atomized liquid spray from an airblast nozzle representative of the present invention.

The improved atomization performance of nozzle 40 of the present invention becomes apparent with reference to FIG. 9 wherein the fuel spray of a airblast nozzle having atomizing air vanes of a conventional, curved design (FIG. 9A) may be compared visually with the spray from a nozzle provided in accordance with the present invention (FIG. 9B) as having aerodynamic outer vanes 102 of the airfoil shape described hereinbefore in connection with FIGS. 4–8. With fuel flow being provided through both nozzles at 10.7 lbm/hr, and with air flow being provided at a pressure drop of 2.0 in ($H_2O$), liquid streaks or "ligaments" and large or non-uniform droplets may be seen in the spay of FIG. 9A which are not seen in the spray of FIG. 9B, both of which sprays are at about the same cone angle. Without being bound by theory, it is speculated that with respect to the spray of FIG. 9A, circumferential non-uniformity in total pressure in the primary atomizing air, caused by wakes, vortices, separations, or other secondary flows, produces a region just downstream of the prefilmer wherein the fuel film is not immediately atomized. Such effect leads to the development of the liquid ligaments which are not significantly further atomized by the secondary atomizing air. In contrast, the well-conditioned primary atomizing air flow directed through the aerodynamic swirler vanes of the nozzle of FIG. 9B is delivered to the fuel sheet discharge at a substantially uniform velocity. Quantitatively, the average droplet size of the spray, as may be expressed by its Sauter Mean Diameter (SMD), can be reduced up to 50% or more.

As it is anticipated that certain changes may be made in the present invention without departing from the precepts herein involved, it is intended that all matter contained in the foregoing description shall be interpreted in as illustrative rather than in a limiting sense. All references cited herein are expressly incorporated by reference.

What is claimed is:

1. A method of atomizing fuel dispensed from a nozzle into a combustion chamber of a gas turbine engine, said method comprising the steps of:

(a) providing said nozzle as comprising:

a body assembly including an inner fuel passage which extends axially along a longitudinal axis to a first terminal end defining a first discharge orifice of said nozzle, and an annular first outer atomizing air passage extending coaxially with said inner fuel passage along said longitudinal axis to a second terminal end disposed concentrically with said first terminal end and defining a second discharge orifice; and an array of first turning vanes each being configured generally in the shape of an airfoil and disposed within said first outer atomizing air passage in a circular locus about said longitudinal axis, each of said first turning vanes having a pressure side and an opposing suction side and extending axially along a respective one of a corresponding array of chordal axes each disposed at a given turning angle to said longitudinal axis from a leading edge surface to a tapering trailing edge surface, the suction side of each of said first turning vanes being spaced-apart from a juxtaposing pressure side of an adjacent one of said first turning vanes to define a corresponding one of a plurality of aligned air flow channels therebetween, (b) directing a fuel flow through said inner fuel passage;

(c) directing a first atomizing air flow through said air flow channels;

(d) discharging said fuel flow from said first discharge orifice into said combustion chamber as a generally annular sheet; and (e) discharging said first atomizing air flow into said combustion chamber as a generally annular swirl from said second discharge orifice, said swirl having a generally uniform velocity profile and being directed to impinge said sheet such that said sheet is atomized into a spray of droplets of substantially uniform size.

2. The method of claim 1 wherein the suction side of each of said first turning vanes is generally convex and the pressure side of each of said first turning vanes is generally concave.

3. The method of claim 1 wherein a segment of the suction side of each of said first turning vanes adjacent said trailing edge surface is disposed generally parallel to a corresponding segment of the pressure side of said adjacent one of said first turning vanes such that each of said air flow channels is defined as having a substantially uniform radial extent between the corresponding pressure and suction side segments.

4. The method of claim 1 wherein said turning angle is between about 40–70°.

5. The method of claim 1 wherein said body assembly comprises:

a generally annular conduit member including a circumferential wall portion having an inner radial surface which defines said inner fuel passage and an outer radial surface configured to define said first turning vanes; and a generally annular first shroud member disposed coaxially over said conduit member and having an outer radial surface and an inner radial surface which is spaced-apart from said body member outer radial surface to define said first outer atomizing air passage therebetween.

6. The method of claim 1 wherein said body assembly further includes an annular second outer atomizing air passage which extends coaxially with said first outer atomizing air passage along said longitudinal axis to a third terminal end disposed concentrically with said second terminal end and defining a third discharge orifice, and wherein said nozzle further comprises an array of second turning vanes disposed within said second outer atomizing air passage in a generally circular locus about said longitudinal axis, said method further comprising the additional steps of:

directing a second atomizing air flow through said second air flow channels; and discharging said second atomizing air flow into said combustion chamber from said third discharge orifice, said second atomizing air flow being directed to impinge on the discharges from said first and said second discharge orifice.

7. The method of claim 6 wherein said first shroud member annular surface is configured to define said array of said second vanes, and wherein said assembly further comprises a generally annular second shroud member disposed coaxially over said first shroud member and having an inner radial surface which is spaced-apart from said first shroud member outer radial surface to define said second outer atomizing air passage therebetween.

8. The method of claim 1 wherein said fuel flow is directed annularly through said fuel passage, said method further comprising the additional steps of:

directing an inner air flow within said fuel flow through said fuel passage; and discharging said inner air flow into said combustion chamber from said third discharge orifice, said inner air flow being directed to flow within said sheet discharged from said first discharge orifice.

* * * * *